US008131185B2

(12) United States Patent
Sato et al.

(10) Patent No.: US 8,131,185 B2
(45) Date of Patent: Mar. 6, 2012

(54) CHARGING DEVICE, DEVELOPMENT DEVICE, AND IMAGE FORMING APPARATUS

(75) Inventors: Toshiharu Sato, Tokyo (JP); Masahiro Kawano, Tokyo (JP)

(73) Assignee: Oki Data Corporation, Tokyo (JP)

( * ) Notice: Subject to any disclaimer, the term of this patent is extended or adjusted under 35 U.S.C. 154(b) by 380 days.

(21) Appl. No.: 12/471,746

(22) Filed: May 26, 2009

(65) Prior Publication Data

US 2009/0324291 A1 Dec. 31, 2009

(30) Foreign Application Priority Data

Jun. 30, 2008 (JP) ..... 2008-171151

(51) Int. Cl.
*G03G 15/02* (2006.01)

(52) U.S. Cl. ..... 399/174
(58) Field of Classification Search ..... 399/174, 399/168, 128; 361/214, 220
See application file for complete search history.

(56) References Cited

U.S. PATENT DOCUMENTS

| | | | | |
|---|---|---|---|---|
| 5,278,614 | A * | 1/1994 | Ikegawa et al. | 399/174 |
| 5,787,327 | A * | 7/1998 | Matsushita et al. | 399/130 |
| 5,842,087 | A * | 11/1998 | Matsushita et al. | 399/174 |
| 2009/0324290 | A1 * | 12/2009 | Kawano et al. | 399/174 |

FOREIGN PATENT DOCUMENTS

| | | | |
|---|---|---|---|
| JP | 62-168173 | A | 7/1987 |
| JP | 10-198122 | A | 7/1998 |
| JP | 2006-332292 | A | 12/2006 |

* cited by examiner

*Primary Examiner* — Sophia S Chen
(74) *Attorney, Agent, or Firm* — Panitch Schwarze Belisario & Nadel LLP

(57) ABSTRACT

A charging device includes a charging member and a charging power source portion. The charging member, in a sheet shape, is secured by contacting a region of an electrostatic latent image to be formed on a rotatable image carrier. The charging power source portion applies charging voltage to the charging member. The charging member includes a plurality of holes.

12 Claims, 7 Drawing Sheets

CHARGING DEVICE, DEVELOPMENT DEVICE, AND IMAGE FORMING APPARATUS

BACKGROUND OF THE INVENTION

1. Field of the Invention

The present invention relates to a charging device charging a photosensitive drum serving as an image carrier with a charging film serving as a charging member, a development device developing a toner image on a recording medium using the charging device included therein, and an image forming apparatus developing and outputting image data input on a recording medium based on certain control using the development device included therein.

2. Description of Related Art

In a related art image forming apparatus such as a printer, a photocopier, a facsimile machine, and a multicolor electrophotographic recording device, a surface of a photosensitive drum is uniformly charged by a charging film and forms an electrostatic latent image thereon by an exposure source based on image information, and toner serving as developer is adhered to the electrostatic latent image to form a toner image. Such a toner image is transferred to the recording medium and is fixed by a fixing device, thereby forming the toner image fixed on the recording medium.

For example, Japanese Un-examined Patent Application Publication No. 2006-332292 discloses a charging device charging a surface of a photosensitive drum using a contact method. The charging device is held by an urging member at one end portion thereof and includes a charging film at another end portion thereof. The charging film contacts a region of an electrostatic latent image to be formed on the photosensitive drum, and the charging device using the contact method allows the charging film to be applied with charging voltage.

Such a charging device disclosed in the above patent document, however, can use only a small portion of the charging film to charge the photosensitive drum, causing difficulty of uniformly charging the surface of the photosensitive drum.

The present invention provides a charging device capable of uniformly charging a surface of a photosensitive drum, a development device including such a charging device, and an image forming apparatus including such a development device.

BRIEF SUMMARY OF THE INVENTION

According to one aspect of the invention, a charging device includes a charging member and a charging power source portion. The charging member, in a sheet shape, is secured by contacting a region of an electrostatic latent image to be formed on a rotatable image carrier. The charging power source portion applies charging voltage to the charging member. The charging member includes a plurality of holes.

According to another aspect of the present invention, a development device includes a charging device such as described above.

According to another aspect of the present invention, an image forming apparatus includes a development device having a charging device such as described above.

Additional features and advantages of the present invention will be more fully apparent from the following detailed description of embodiments, the accompanying drawings and the associated claims.

BRIEF DESCRIPTION OF THE DRAWINGS

A more complete appreciation of the aspects of the invention and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
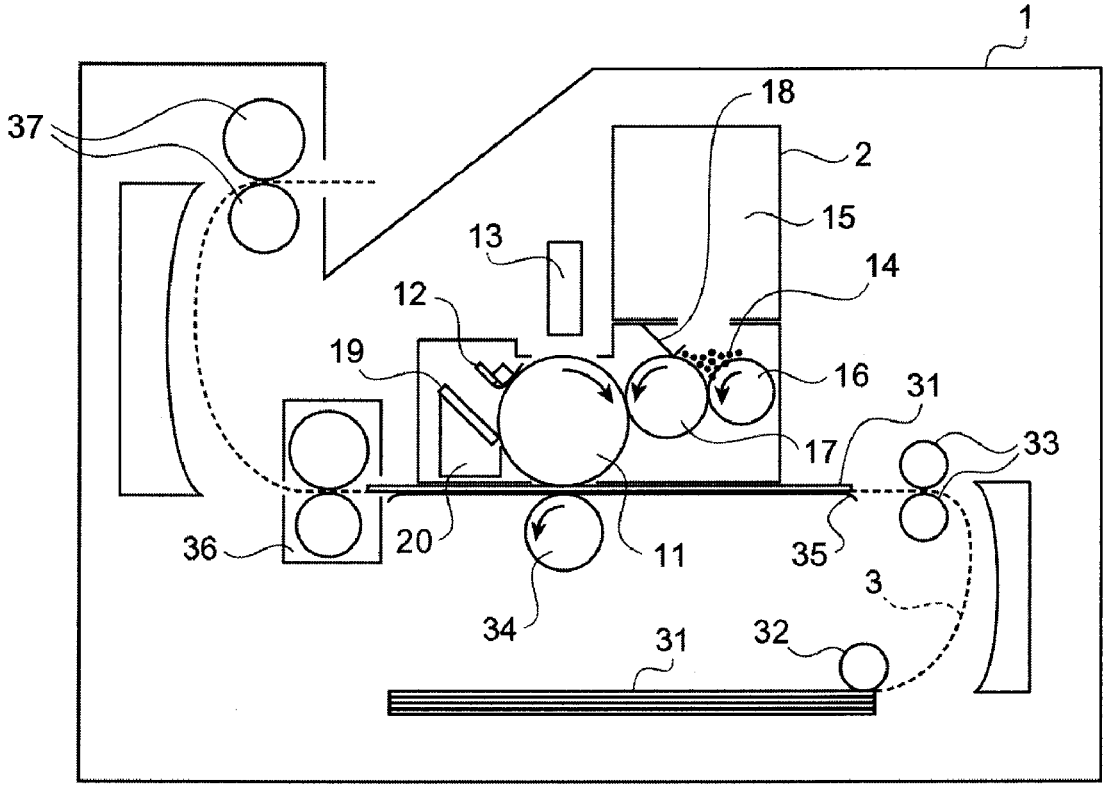
FIG. 1 is a schematic diagram illustrating an image forming apparatus according to a first embodiment of the present invention.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

A charging device, a development device, and an image forming apparatus according to embodiments of the present invention are now described with reference to drawings, and like reference numerals designate identical or corresponding parts throughout the several views.

First Embodiment

A charging device according to a first embodiment includes through holes 12C in a charging film 12, so that a charging area on a surface of a photosensitive drum 11 is increased in a case where the photosensitive drum 11 is charged by the charging film 12, and any of remaining residual toner 81, additives 82, and foreign substances 83 can be removed from the surface of the photosensitive drum 11.

Figure 2:
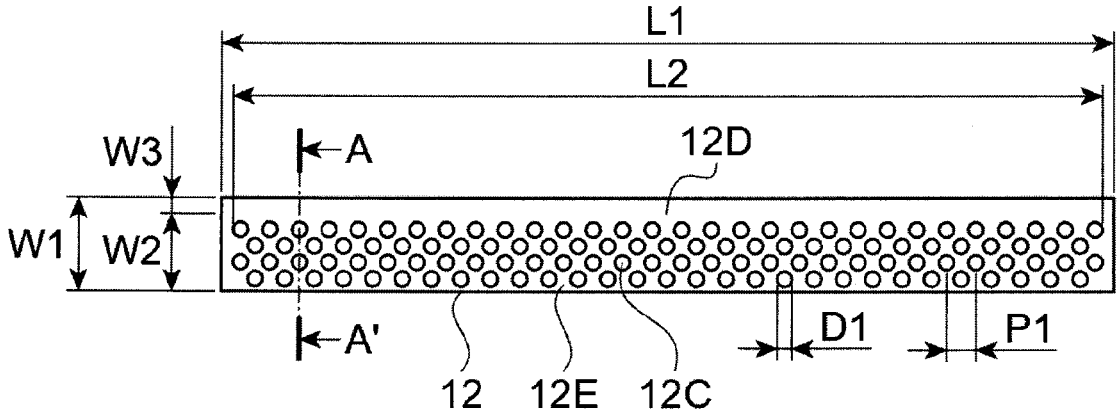
FIG. 2 is a bottom plan view illustrating a charging film according to the first embodiment of the present invention.

An image forming apparatus 1 serving as an electrophotographic printer according to the first embodiment is described with reference to FIG. 1. The charging film 12 according to the first embodiment is described with reference to FIGS. 2 and 3 in a bottom plan view and in a cross-sectional view taken along line A-A' of FIG. 2, respectively.

The image forming apparatus 1 includes: a development device 2 developing an image on a recording medium 31 based on image information; and a sheet conveyance path 3, in a substantially letter "S" shape, on which the recording medium 31 is conveyed. The recording medium 31 is conveyed from a conveyance roller 32 disposed in a start point of the sheet conveyance path 3 to the development device 2, and the recording medium 31 having thereon the image developed by the development device 2 is ejected by an ejection roller 37 disposed in an end point of the conveyance path 3. The recording medium 31 serves as a recording sheet of a prescribed size and forms the image developed thereon based on monochrome or multicolor image information. The recording medium 31, for example, is a sheet such as a recycled sheet, a glossy sheet, and a quality sheet, or an overhead projector (OHP) film.

The development device 2 disposed in the image forming apparatus 1 includes: the photosensitive drum 11 serving as an image carrier carrying an electrostatic latent image formed based on the image information; the charging film 12 serving as a charging mechanism allowing an electrical charge to be accumulated on the surface of the photosensitive drum 11; a print head 13 serving as an exposure mechanism irradiating the surface of the photosensitive drum 11 with light corresponding to the image information; toner 14 serving as developer; a toner cartridge 15 storing the toner 14 therein; a supply roller 16 supplying the toner 14 to a development roller 17; the development roller 17 developing the electrostatic latent image on the surface of the photosensitive drum 11 with the toner 14; a development blade 18 uniformly regulating a thickness of the toner 14; a cleaning blade 19 scraping the toner 14 remained from the photosensitive drum 11; and a waste toner collection carrier 20 carrying the toner 14 scraped by the cleaning blade 19 to a collection container (not shown).

The photosensitive drum 11 is capable of accumulating the electrical charge on the surface thereof to carry the electrostatic latent image formed based on the image information. The photosensitive drum 11 is formed in a cylindrical shape and is disposed in a rotatable manner. The photosensitive drum 11 includes a conductive base layer made of aluminum, for example, and a photosensitive layer made of an organic photosensitive member. The photosensitive layer is formed on a surface of the conductive base layer.

The charging film 12 applies prescribed positive or negative voltage to the surface of the photosensitive drum 11, thereby accumulating the electrical charge on the surface of the photosensitive drum 11. The charging film 12 is disposed in such a manner as to contact the surface of the photosensitive drum 11 with certain pressure as illustrated in FIG. 1.

The charging film 12 includes: a base portion 12A; a conductive portion 12B, serving as a surface to contact the surface of the photosensitive drum 11, formed on the base portion 12A by application and hardening of a conductive coating material to the base portion 12A; a plurality of through holes 12C penetrating the charging film 12; a holding portion 12D securing the charging film 12 inside the development device 2; and a free end 12E disposed in an end surface opposite to the holding portion 12D of the charging film 12. The base portion 12A and the conductive portion 12B can be replaced with a conductive member having a power distribution property as described later.

The base portion 12A is formed of a macromolecular film made of polyethylene terephthalate (PET) resin. The base portion 12A is formed in a plate shape and has a length L1 of 226 mm (L1=226 mm), a width W1 of 25 mm (W1=25 mm), and a thickness H1 of 50 μm (H1=50 μm), for example. The base portion 12A can be formed of a material made of polyester, polycarbonate, and polyamide, for example. For example, in a case where the base portion 12A is formed as a conductive base portion made of polycarbonate, polyimide, tetrafluoroethylene-ethylene copolymer (ETEF), and polyvinylidene fluoride (PVDF) applied with carbon serving as a conductor, the conductive portion 12B does not need to be provided.

For example, the base portion 12A having a plane surface with the length L1 of 226 mm and the width W1 of 25 mm is coated with the conductive coating material in such a manner that a thickness H2 of a coating layer becomes 10 μm (H2=10 μm) and is hardened, thereby forming the conductive portion 12B. Application of the electric current to the conductive portion 12B from a power source (not shown) allows discharge to be generated between the charging film 12 and the photosensitive drum 1, thereby charging the surface of the photosensitive drum 11. Herein, the conductive coating material is, for example, made by adding the conductor such as gold, silver, copper, iron, chrome, nickel, platinum, carbon black, and carbon fiber to synthetic resin such as polyester, polyamide, polyimide, polyethylene, polycarbonate, polyolefin, polyurethane, polyvinylidene fluoride, polyvinyl chloride, phenol resin, acrylic and epoxy. In a case where a resistance value of the coating material is excessively low, the electric current is locally flown to a pinhole or a flaw on the surface of the photosensitive drum 11, causing a leakage phenomenon. In a case where the resistance value of the coating material is excessively high, on the other hand, an amount of the electric current is decreased, causing suppression of charging and discharging the surface of the photosensitive drum 11. Consequently, the resistance value of the coating material is preferably between 10 E+3Ω and 10 E+8Ω, for example.

Each of the plural through holes 12C, for example, has a diameter D1 of 1 mm (D1=1 mm) and is provided with an interval P1 of 2 mm (P1=1 mm) therebetween. The plural through holes 12C are arranged in zigzag, and are, for example, provided in a region having a length L2 of 224 mm (L2=224 mm) and a width W2 of 20 mm (W2=20 mm) within the surface of the base portion 12A having the length L1 of 226 mm and the width W1 of 25 mm. Each of the through holes 12C penetrates the charging film 12 laminated by the base portion 12A and the conductor portion 12B. The surface of the photosensitive drum 11 is charged by the discharge generated in a vicinity of the through hole 12C of the conductive portion 12B with respect to the surface of the photosensitive drum 11.

The holding portion 12D is provided in one end of the plane surface of the base portion 12A having the length L1 of 226 mm and the width W1 of 25 mm. Particularly, the holding portion 12D is positioned within a region having the length L1 of 226 mm and a width W3 of 5 mm (W3=5 mm) of the base portion 12A. The charging film 12 is secured in the development device 2 by a sponge 71 and a holding member 72 (described later) using the holding portion 12D. The free end 12E is provided in another end opposite to the holding portion 12D provided in one end of the plane surface of the base portion 12A. The free end 12E is provided in another end of the plane surface of the base portion 12A, that is, the free end 12E is positioned opposite to the holding portion 12D provided in the one end of the plane surface of the base portion 12A. The free end 12E is not secured to the sponge 71 and has flexibility at a certain level.

The print head 13 irradiates the surface of the photosensitive drum 11 with the light corresponding to the image information, so that the electrostatic latent image is formed on the surface of the photosensitive drum 11. The print head 13 is disposed above the photosensitive drum 11, and includes a combination of plural light emitting diode (LED) elements, a lens array, and an LED drive element. The toner 14 serves as the developer and visualizes the image information by adhesion thereof to the electrostatic latent image formed on the surface of the photosensitive drum 11. The toner cartridge 15 serves as a container storing the toner 14 therein and is disposed above the supply roller 16. The toner cartridge 15 is detachably disposed with respect to the image forming apparatus 1 so as to be replaced in a case where the toner 14 is consumed.

The supply roller 16 is disposed in such a manner as to supply the toner 14 to the development roller 17 by contacting the development roller 17 while rotating thereof. For example, the supply roller 16 includes a metal shaft having conductivity and rubber applied with a foam agent. The rubber is coated on the metal shaft to form the supply roller 16. The development roller 17 is disposed in a rotatable manner while contacting the surface of the photosensitive drum 11 with certain pressure. The development roller 17 carries the toner 14 to the photosensitive drum 11 while rotating thereof, and develops the electrostatic latent image formed on the surface of the photosensitive drum 11 with the toner 14. The development blade 18 is pressed against a surface of the development roller 17 at one end thereof. The development blade 18 scrapes the toner 14 exceeding a certain level of the toner 14 supplied from the supply roller 16 to the surface of the development roller 17, thereby uniformly regulating the thickness of the toner 14 to be supplied to the surface of the photosensitive drum 17. Such a development blade 18 is formed of a plate elastic member made of stainless, for example.

The cleaning blade 19 scrapes the toner 14 remained on the photosensitive drum 11 after the toner image formed on the photosensitive drum 11 is transferred to the recording medium 31. The cleaning blade 19 is disposed on an upper stream side in a rotation direction of the photosensitive drum 11 relative to the charging film 12, and contacts the surface of the photosensitive drum 11 with application of certain pressure. The waste toner collection carrier 20 carries the toner 14 scraped by the cleaning blade 19 to the collection container (not shown). The waste toner collection carrier 20 includes a carriage screw (not shown) therein.

A description is now given of the sheet conveyance path 3 disposed in the image forming apparatus 1. The sheet conveyance path 3 serves as a path on which the recording medium 31 is conveyed from the start point to the end point of the sheet conveyance path 3 through a conveyance roller 33, a transfer roller 34, a transfer belt 35, and a fixing device 36. The conveyance roller 32 and the conveyance roller 37 are respectively disposed in and serve as the start point and the end point of the sheet conveyance path 3. A description of each of the conveyance rollers 32, 33, and 37, transfer roller 34, transfer belt 35, and fixing device 36 disposed along the sheet conveyance path 3 is given below.

The conveyance roller 32 rotates in a state of being pressed against the recording medium 31 and separately conveys the recording medium 31 sheet by sheet, thereby supplying the recording medium 31 to the conveyance roller 33.

The conveyance roller 33 supplies the recording medium 31 supplied from the conveyance roller 32 to the transfer belt 35.

The transfer roller 34 is rotatably disposed below the photosensitive drum 11 such that the transfer roller 34 and the photosensitive drum 11 sandwich the recording medium 31 therebetween. The transfer roller 34 is applied with a bias voltage reverse to the voltage applied to the photosensitive drum 11, so that the toner image formed on the surface of the photosensitive drum 11 is transferred to the recording medium 31.

The transfer belt 35 serving as a conveyance mechanism conveys the recording medium 31 to the development device 2 developing the image information, and holds the toner image with the toner 14 on a circumference surface thereof. The transfer belt 35 is an endless belt and absorbs the recording medium 31.

The fixing device 36 includes a fixing roller and a pressure roller. The fixing roller and the pressure roller of the fixing device 36 are disposed in such a manner as to sandwich therebetween the recording medium 31 conveyed by the transfer belt 35. The fixing device 36 fixes the toner image developed by the development device 2 onto the recording medium 31. Particularly, the toner image adhered to the recording medium 31 is melted by the application of the heat supplied from a heat source (not shown) such as a halogen lamp disposed in the fixing roller, and is pressed by the pressure roller, thereby fixing the toner image on the recording medium 31.

The conveyance roller 37 ejects the recording medium 31 having the toner image fixed thereon by the fixing device 36 outside the image forming apparatus 1.

Figure 4:
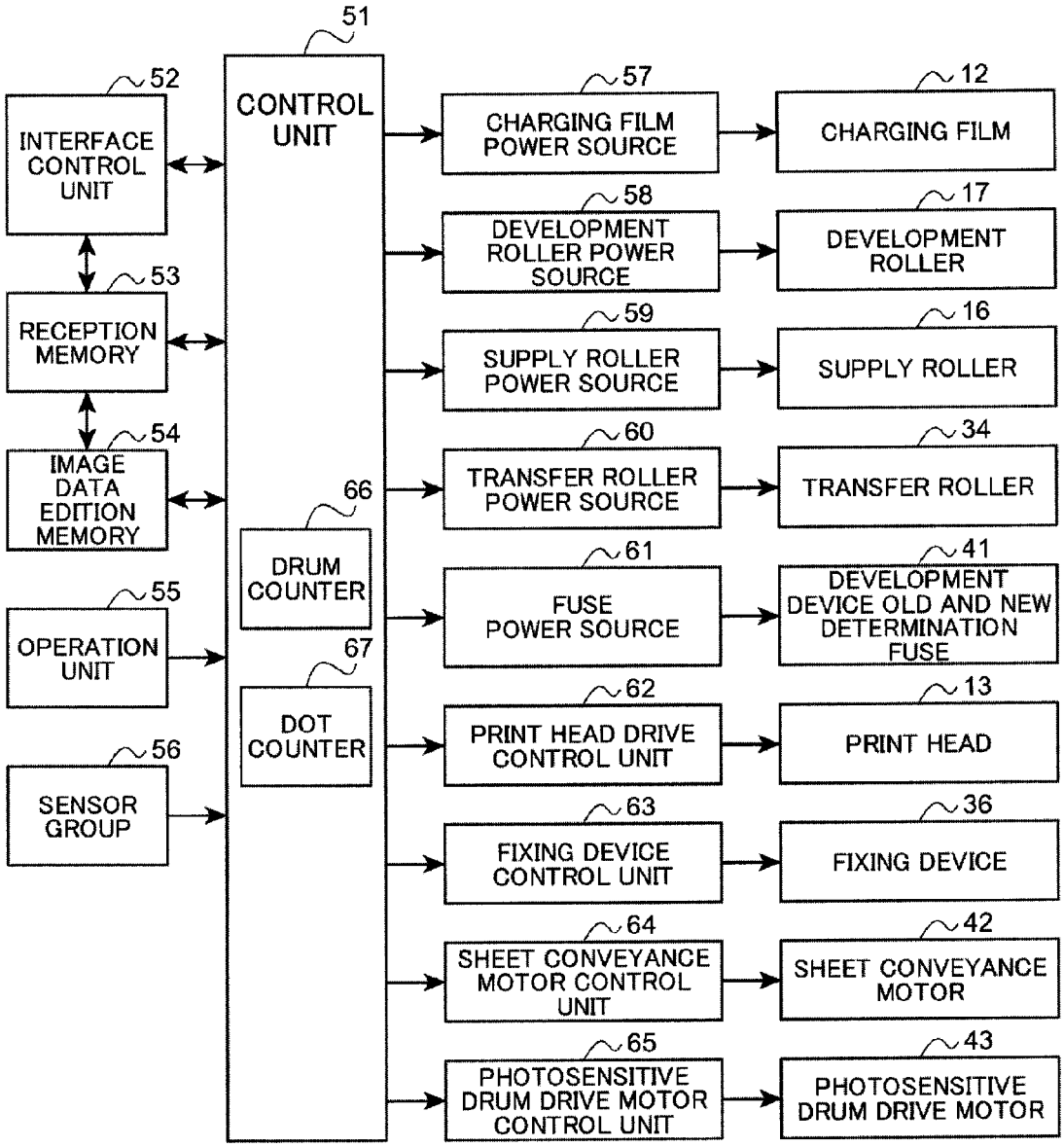
FIG. 4 is a block diagram illustrating the image forming apparatus according to the first embodiment of the present invention.

A description is now given of control of the image forming apparatus 1 according to the first embodiment of the present invention. The image forming apparatus 1 is illustrated in a block diagram of FIG. 4.

The image forming apparatus 1 includes a control unit 51 including a microprocessor, a read only memory (ROM), a random access memory (RAM), an input and output port, and a timer. The image forming apparatus 1 allows the control unit 51 to instruct and control a series of development processes developing the image information on the recording medium 31.

The control unit 51 is connected to: an interface control unit 52 controlling reception of data and a control command from a higher-level device (not shown); a reception memory 53 storing print data input to the interface control unit 52; an image data edition memory 54 storing image data formed by edition of the print data; an operation unit 55 used by an operator to operate the image forming apparatus 1; a sensor group 56 monitoring an operation state of the image forming apparatus 1; a charging film power source 57 supplying the power to the charging film 12; a development roller power source 58 supplying the power to the development roller 17; a supply roller power source 59 supplying the power to the supply roller 16; a transfer roller power source 60 supplying the power to the transfer roller 34; a fuse power source 61 applying the electric current to a development device old and new determination fuse 41; a print head drive control unit 62 controlling the print head 13; a fixing device control unit 63 controlling the fixing device 36; a sheet conveyance motor control unit 64 controlling a sheet conveyance motor 42; and a photosensitive drum drive motor control unit 65 controlling a photosensitive drum drive motor 43. The control unit 51 includes a drum counter 66 counting a number of rotations of the photosensitive drum 11, and a dot counter 67 counting a number of print dots.

The control unit 51 controls sequence of the image forming apparatus 1 as a whole, thereby executing print operation based on the data and the control command received from the higher-level device. Each of the components connected to and included in the control unit 51 is described in detail below. However, a description of the component described above with reference to FIG. 1 is omitted.

The interface control unit 52 controls reception of the data and the control command from the higher-level device (not shown) based on the instruction from the control unit 51.

The reception memory 53 serves as a readable and writable volatile memory, and temporarily stores the print data input to the interface control unit 52 from the higher-level device based on the instruction from the control unit 51.

The image data edition memory 54, based on the instruction from the control unit 51, receives the print data stored in the reception memory 53 and serves as a readable and writable volatile memory temporarily storing the image data formed by edition of the print data.

The operation unit 55 is used to operate the image forming apparatus 1. The operation unit 55 includes a display unit displaying the operation state of the image forming apparatus 1 and a switch to be used by the user for operation of the image forming apparatus 1.

The sensor group 56 includes a variety of sensors to monitor the operation state of the image forming apparatus 1 over time. The sensor group 56 includes, for example, a sheet position detection sensor, a temperature sensor, a humidity sensor, and a density sensor.

The charging film power source 57 serves as a charging power source unit and applies the prescribed voltage to the charging film 12 according to the instruction of the control unit 51, thereby charging the surface of the photosensitive drum 11. Particularly, the discharge is generated with respect to the surface of the photosensitive drum 11 in the circumference vicinity of the through hole 12C of the conductive portion 12B included in the charging film 12, and end portions 12F and 12G of the conductive portion 12B, so that the surface of the photosensitive drum 11 is charged.

The development roller power source 58, according to the instruction of the control unit 51, applies the prescribed voltage to the development roller 17 allowing the toner 14 to adhere to the electrostatic latent image formed on the surface of the photosensitive drum 11.

The supply roller power source 59, according to the instruction of the control unit 51, applies the prescribed voltage to the supply roller 16 supplying the toner 14 to the development roller 17.

The transfer roller power source 60, according to the instruction of the control unit 51, applies the prescribed voltage to the transfer roller 34 transferring the toner image formed on the photosensitive drum 11 to the recording medium 31. The transfer roller 34 is applied with the bias voltage reverse to the voltage applied to the photosensitive drum 11.

The development device old and new determination fuse 41 serves as a fast-blow fuse. The development device old and new determination fuse 41, according to the instruction of the control unit 51, determines whether or not the development device 2 is not used ever, and is applied with the prescribed voltage from the fuse power source 61.

The print head drive control unit 62, according to the instruction of the control unit 51, drives the print head 13 forming the electrostatic latent image on the surface of the photosensitive drum 11 by irradiation of the surface of the photosensitive drum 11 with the light after the image data stored in the image data edition memory 54 is imported to the print head 13.

The fixing device control unit 63, according to the instruction of the control unit 51, controls the fixing device 36 including the fixing roller and the pressure roller.

The sheet conveyance motor control unit 64, according to the instruction of the control unit 51, controls the sheet conveyance motor 42 driving the conveyance rollers 32, 33, 34, and 37, so that the recording medium 31 is conveyed or stopped inside the image forming apparatus 1.

The photosensitive drum drive motor control unit 65, according to the instruction of the control unit 51, controls the photosensitive drum drive motor 43 driving the photosensitive drum 11, so that the toner image formed on the photosensitive drum 11 is developed on the recording medium 31.

The drum counter 67, according the instruction of the control unit 51, measures a number of dots of the image data formed by the image data edition memory 54. Herein, the number of dots of the image data corresponds to one sheet of the recording media 31.

The drum counter 66, according to the instruction of the control unit 51, measures an accumulated rotation number of the photosensitive drum 11 in connection with the measurement of the number of dots of the image data by the dot counter 67.

Figure 3:
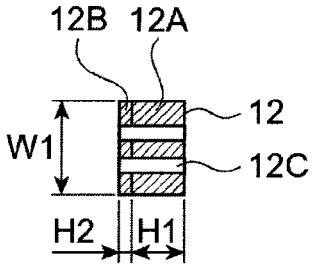
FIG. 3 is a cross-sectional view illustrating the charging film taken along line A-A' of FIG. 2 according to the first embodiment.
Figure 5:
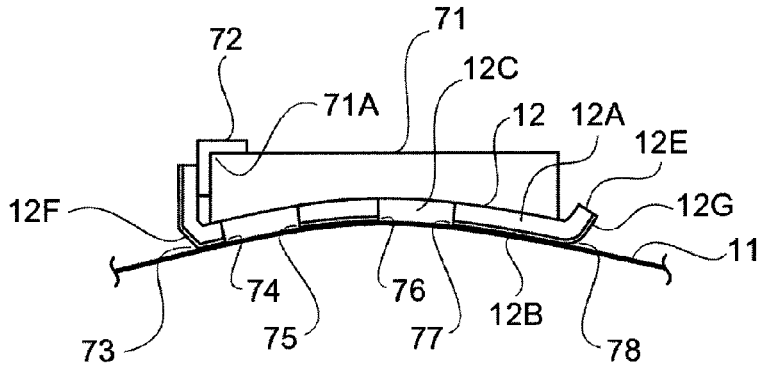
FIG. 5 is a schematic diagram illustrating the charging film in a state of being contact with a photosensitive drum according to the first embodiment of the present invention.
Figure 6:
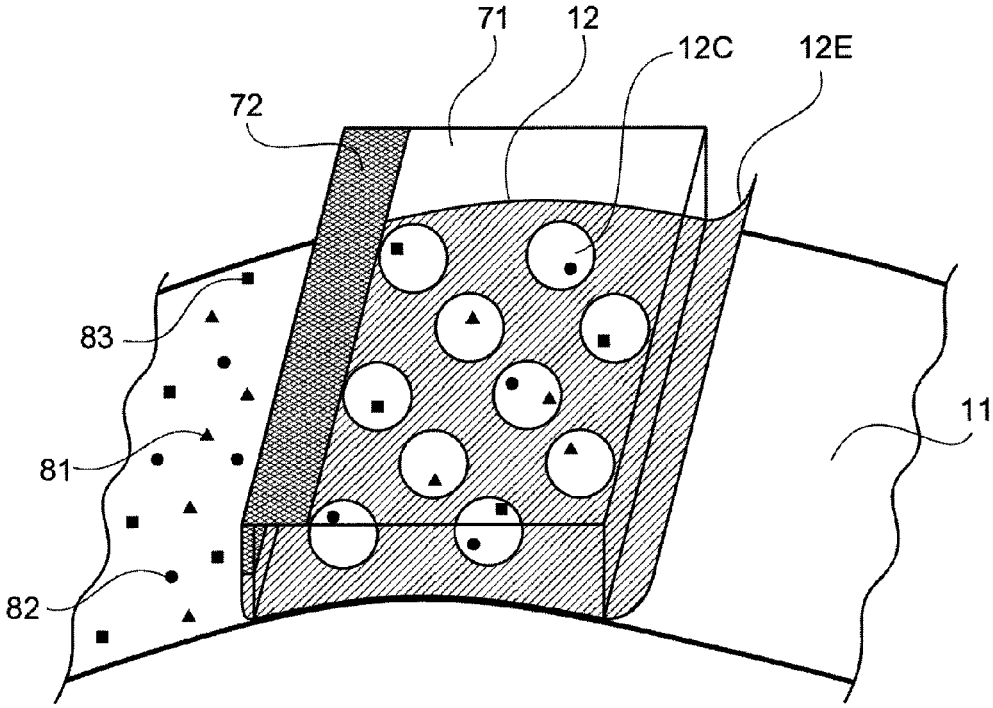
FIG. 6 is another schematic diagram illustrating the charging film in a state of being contact with the photosensitive drum according to the first embodiment of the present invention.

Referring to FIGS. 5 and 6, a description is given of the charging film 12 in a state of being in contact with the photosensitive drum 11 according to the first embodiment of the present invention. An arrangement and a number of the through holes 12C in the charging film 12 illustrated in FIGS. 5 and 6 are different from those illustrated in FIGS. 2 and 3 for the sake of simplicity.

The charging film 12 is pressed from the side of the base portion 12A by the sponge 71 serving as an urging member, so that the side of the conductive portion 12B is provided in such a manner as to contact the surface of the photosensitive drum 11. When the print operation begins, the surface of the photosensitive drum 11 is charged by the conductive portion 12B of the charging film 12. Moreover, the charging film 12 in a state of being in contact with the photosensitive drum 11 is described in detail below.

The sponge 71 serving as the urging member urges the charging film 12, allowing the charging film 12 to contact the photosensitive drum 11. The sponge 71 is made of foam resin or a rubber material having a porous three-dimension structure. Particularly, the sponge 71 can be made of the foam resin or the rubber such as polyurethane, polyethylene, polyamide, olefin, melanin, polypropylene, acrylonitrile-butadiene rubber (NBR), ethylene-propylene terpolymer (EPDM), natural rubber, styrene-butadiene rubber, chloroprene, silicone, and nitrile. The sponge 71 includes a void or a salient and reentrant cell inside thereof and on the surface thereof, thereby having elasticity. Preferably, such a cell has a diameter of smaller than or equal to 500 μm. More preferably, the cell has the diameter between 50 and 100 μm.

The holding member 72 is an "L" shaped plate member made of a rigid material, and adhesively secures the charging film 12 and the sponge 71. The holding member 72 is adhesively secured by a surface of the holding portion 12D of the charging film 12 and a surface of a holding portion 71A of the sponge 71.

Herein, in a case where the charging film 12 is applied with the prescribed voltage by the charging film power source 57, the discharge is generated between the conductive portion 12B of the charging film 12 and the surface of the photosensitive drum 11. A certain space in which the discharge is generated is referred to as a discharge gap. As illustrated in FIG. 5, the discharge is generated in the end portions 12F and 12G and the circumference vicinity of each of the through holes 12C of the charging film 12. Herein, the discharge gaps made in the end portions 12F and 12G of the charging film 12 are referred to as a discharge gap 73 and a discharge gap 78, respectively. Similarly, the discharge gaps made in the circumference vicinity of the through holes 12C of the charging film 12 are referred to as discharge gaps 74, 75, 76, and 77, respectively as illustrated in FIG. 5. An advantage of the discharge gap is described in detail later.

Now, a description is given of reduction of poor discharge on the surface of the photosensitive drum 11 caused by the remaining residual toner 81, the additive 82, and the foreign substance 83.

When the print operation begins, the surface of the photosensitive drum 11 is charged by the discharge generated from the conductive portion 12B of the charging film 12 with respect to the surface of the photosensitive drum 11. Herein, the discharge is generated in a case where the gap serving as the certain space exists between the surface of the photosensitive drum 11 and the conductive portion 12B. Therefore, in a case where the surface of the photosensitive drum 11 and the conductive portion 12B completely contact each other or are excessively separated from each other, the discharge does not occur. Particularly, a length of the gap in which the discharged is generated on the surface of the photosensitive drum 11 depends on the voltage value to be applied to the conductive portion 12B. The length of the gap is generally between several μm and several tens of μm, and is more preferably approximately 5 μm.

An advantage of having the through holes 12C in the charging film 12 is described after a description is given of the charging film 12 without having the through holes 12C.

In a case where the charging film 12 has no through hole 12C, the surface of the photosensitive drum 11 is charged by the discharge generated by the charging film 12 in the discharge gaps 73 and 78. The surface of the photosensitive drum 11, however, has the remaining residual toner 81, the additive 82, and the foreign substance 83 each of which is not removed by the cleaning blade 19. Herein, in a case where the print operation is repeated, the remaining residual toner 81, the additive 82, and the foreign substance 83 are blocked and accumulated in the end portion 12F of the charging film 12 with rotation of the photosensitive drum 11. Particularly, since the additive 82 has a high resistance value so as not to release an electron acquired by the triboelectric charge, the additive 82 serves as a high resistance layer between the surface of the photosensitive drum 11 and the conductive portion 12B, causing interruption of the surface of the photosensitive drum 11 to be charged.

Since the end portion 12G of the charging film 12 is provided in the side of the free end 12E of the charging film 12, the discharge does not stably occur. That is, since the photosensitive drum 11 rotates in a state of being in contact with the charging film 12 during the print operation, the gap length in the end portion 12G is easily changed by vibration of the free end 12E of the charging film 12, causing not stably generating the discharge. Therefore, in a case where the through hole 12C is not provided in the charging film 12, the discharge does not stably occur to the surface of the photosensitive drum 11, causing a charge amount to be not stable. Consequently, density unevenness or a vertical line caused by the poor charge is generated on the toner image developed on the recording medium 31.

In a case where the through holes 12C are provided in the charging film 12, the surface of the photosensitive drum 11 is charged by the discharge generated by the charging film 12 in the discharge gaps 74, 75, 76, and 77 in the circumference vicinity of the through holes 12C in addition to the discharge gaps 73 and 78. Therefore, the area on the surface of the photosensitive drum 11 to be charged increases. Moreover, unlike in the end portions 12F and 12G, the remaining residual toner 81, the additive 82, and the foreign substance 83 adhered to the photosensitive drum 11 are removed from the surface of the photosensitive drum 11 in the through holes 12C. That is, the remaining residual toner 81, the additive 82, and the foreign substance 83 are entered into a hole of the sponge 71 through the through hole 12C so as to be removed from the surface of the photosensitive drum 11 without accumulation in the through hole 12C.

According to the first embodiment of the present invention, the through hole 12C provided in the charging film 12, for example, has the diameter of 1 mm (D1 =1 mm). However, any hole having a diameter of smaller than or equal to 5 mm may be provided, so that the surface of the photosensitive drum 11 may be uniformly charged. In a case where the diameter of the through hole 12C exceeds 5 mm, a contour of the charging film 12 may be distorted, or the area of the discharge gap may be scattered depending on a bending moment strength of the charging film 12. Consequently, the surface of the photosensitive drum 11 may not be uniformly charged. Moreover, the area in which the discharge is generated from the conductive portion 12B with respect to the surface of the photosensitive drum 11 needs to be increased to uniformly charge the photosensitive drum 11. Therefore, an integration degree of the through hole 12C is preferably increased by an interval of the through holes 12C and an arrangement of the through holes 12C. Particularly, the interval of the through holes 12C provided in the charging film 12 is arranged to be smaller than or equal to a value double the diameter of the through hole 12C, and the through holes 12C are arranged in zigzag. The through hole 12C may be a triangle, a rectangle, an oval, and a semicircle. However, a size of the through hole 12C needs to be larger than that of the remaining residual toner 81, the additive 82, and the foreign substance 83 adhered to the surface of the photosensitive drum 11.

According to the first embodiment described above, the through holes 12C are provided in the charging film 12, so that the area on the surface of the photosensitive drum 11 to be charged is increased in a case where the photosensitive drum 11 is charged by the charging film 12. Moreover, since the remaining residual toner 81, the additive 82, and the foreign substance 83 are removed from the surface of the photosensitive drum 11, the charge amount on the surface of the photosensitive drum 11 is stabilized, thereby reducing generation of the density unevenness or the vertical line caused by the poor charge on the toner image developed on the recording medium 31.

Second Embodiment

In a charging device according to a second embodiment, a charging film 91 includes a salient portion 91H, so that a surface of a photosensitive drum 11 is stably charged in a case where the photosensitive drum 11 is charged by the charging film 91. Moreover, a remaining residual toner 81, an additive 82, and a foreign substance 83 are efficiently removed from the surface of the photosensitive drum 11. The charging device of the second embodiment is substantially similar to that of the first embodiment, except for the charging film 91.

Like components are given the same reference numerals as above embodiment, and descriptions thereof are omitted for the sake of simplicity.

Now, a description is given of the charging film 91 having the salient portion 91H according to the second embodiment of the present invention. Compared with the charging film 12 of the first embodiment described above, the charging film 91 of the second embodiment includes the salient portion 91H. Therefore, the surface of the photosensitive drum 11 is charged more stably, and the remaining residual toner 81, the additive 82, and the foreign substance 83 are more efficiently removed from the surface of the photosensitive drum 11.

Figure 7:
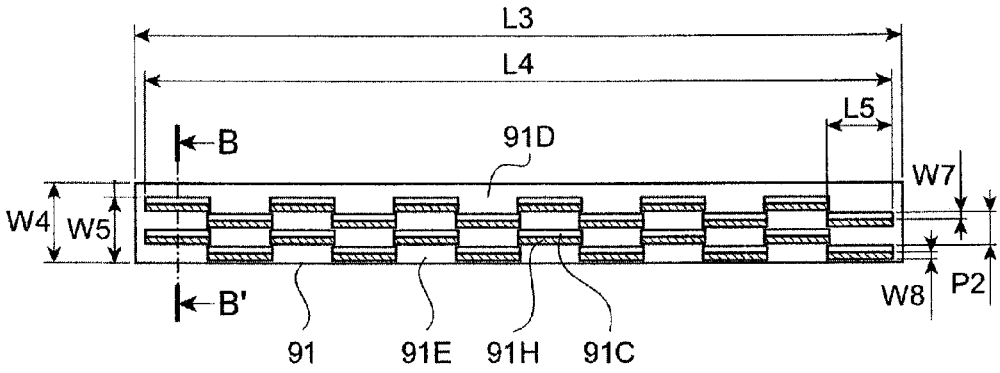
FIG. 7 is a bottom plan view illustrating a charging film according to a second embodiment of the present invention.
Figure 8:
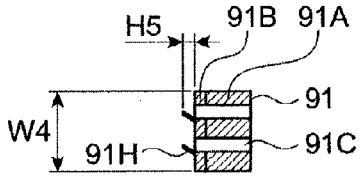
FIG. 8 is a cross-sectional view illustrating the charging film taken along line B-B' of FIG. 7 according to the second embodiment of the present invention.

Referring to FIGS. 7, and 8, the charging film 91 according to the second embodiment is illustrated in a bottom plan view and a cross-sectional view, respectively. In FIG. 8, the charging film 91 is illustrated in the cross-sectional view taken along the line B-B' of FIG. 7.

The charging film 91 includes: a base portion 91A serving as an essential portion of the charging film 91; a conductive portion 91B formed by application and hardening of a conductive coating material on the base portion 91A; a plurality of through holes 91C penetrating the charging film 91; a holding portion 91D securing the charging film 91 inside a development device 2; a free end 91E disposed in an end surface opposite to the holding portion 91D of the charging film 91; and the salient portion 91H for generation of stable discharge and removal of the remaining residual toner 81, the additive 82, and the foreign substance 83 efficiently. The through holes 91C of the second embodiment differ from the through holes 12C of the first embodiment. The through holes 91C and the salient portion 91H of the second embodiment are described in detail below.

For example, each of the plural through holes 91C is formed in a rectangular shape with a length L5 of 5 mm (L5=5 mm) and a width W7 of 1 mm (W7=1 mm), and is provided in a region having a length L4 of 224 mm (L4=224 mm) and a width W5 of 20 mm (W5=20 mm) within a surface of the base portion 91A having a length L3 of 226 mm (L3=226 mm) and a width W4 of 25 mm (W4=25 mm). Each of the through holes 91C is provided with an interval P2 of 3 mm (P2=3 mm) therebetween with respect to a rotation direction of the photosensitive drum 11. Moreover, each of the through holes 91C penetrates the charging film 91 laminated by the base portion 91A and the conductor portion 91B. The salient portion 91H, for example, has a length L5 of 5 mm (L5=5 mm), a width W8 of 1 mm (W8=1 mm), and a thickness H5 of 5 μm (H5=5 μm). The salient portion 91H is disposed in a vicinity of each of the through holes 91C in the base portion 91A, and is in a salient tab shape in such a manner as to be against with respect to the rotation direction of the photosensitive drum 11.

Figure 9:
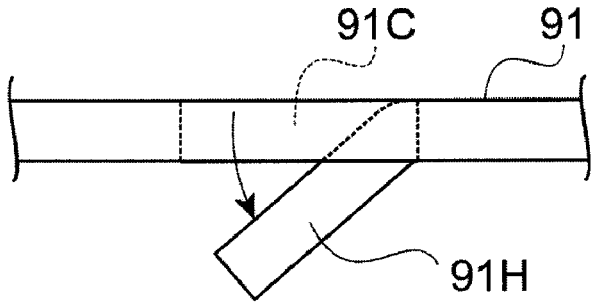
FIG. 9 is a schematic diagram illustrating a method of forming a salient portion of the charging film according to the second embodiment of the present invention.

Now, a description is given of formation of the salient portion 91H provided on the conductive portion 91B with reference to FIG. 9. A method of forming the salient portion 91H of the charging film 91 is illustrated from the side in a schematic diagram of FIG. 9. After a portion of the length L5 and portions of the widths W8 adjacent to the length L5 on the surface of the charging film 91 are cut, that is, after the three portions are cut, a rectangular portion is pressed, and the three portions are peeled and plastically deformed in such a manner as to reach a certain angle using an uncut portion of the length L5 as an axis, thereby forming the salient portion 91H as illustrated in FIG. 9.

Figure 10:
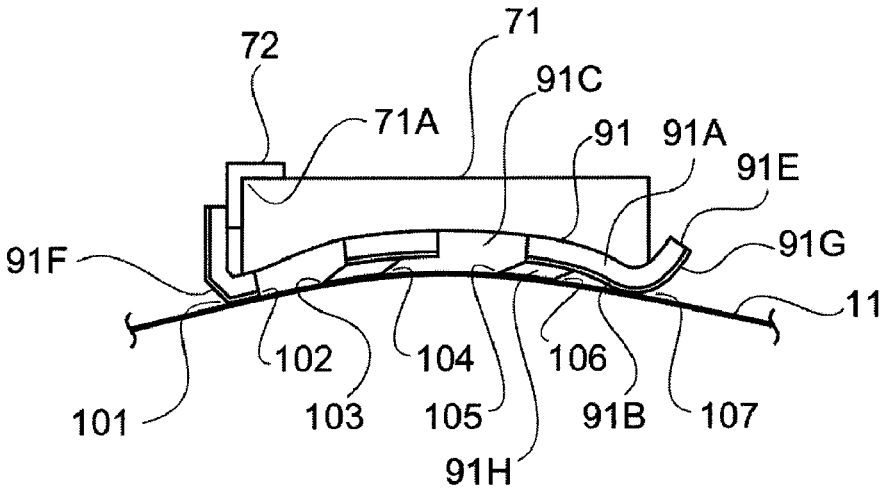
FIG. 10 is a schematic diagram illustrating the charging film in a state of being contact with a photosensitive drum according to the second embodiment of the present invention.
Figure 11:
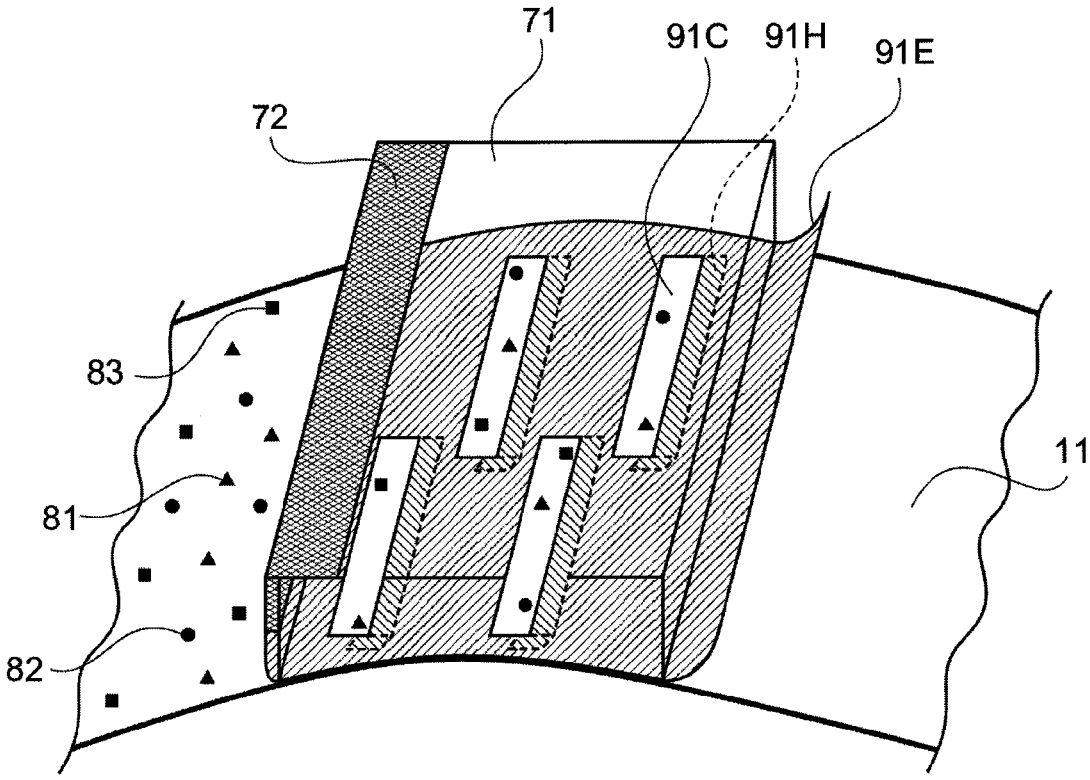
FIG. 11 is another schematic diagram illustrating the charging film in a state of being contact with the photosensitive drum according to the second embodiment of the present invention.

Referring to FIGS. 10 and 11, the charging film 91 in a state of being in contact with the photosensitive drum 11 is illustrated according to the second embodiment. An arrangement and a number of the through holes 91C in the charging film 91 in FIGS. 10 and 11 are different from those of FIGS. 7 and 8 for the sake of simplicity.

The charging film 91 is pressed from the side of the base portion 91A by a sponge 71 serving as an urging member, so that the side of the conductive portion 91B is disposed in such a manner as to contact the surface of the photosensitive drum 11. When print operation begins, the surface of the photosensitive drum 11 is charged by the discharge in the conductive portion 91B of the charging film 91. The charging film 91 in a state of being in contact with the photosensitive drum 11 is described in detail below. Since the sponge 71 and a holding member 72 according to the second embodiment are substantially similar to those of the first embodiment, descriptions thereof are omitted.

When the print operation begins, the discharge is generated between the conductive portion 91B of the charging film 91 and the surface of the photosensitive drum 11. A certain space in which the discharge is generated is referred to as a discharge gap. As illustrated in FIG. 10, the discharge is generated in the end portions 91F and 91G of and a circumference vicinity of each of the through holes 91C of the charging film 91. Herein, the discharge gaps generated in the end portions 91F and 91G of the charging film 91 are referred to as a discharge gap 101 and a discharge gap 107, respectively. Similarly, the discharge gaps generated in the circumference vicinity of the through holes 91C of the charging film 91 are referred to as discharge gaps 102, 103, 104, 105, and 106, respectively as illustrated in FIG. 10. An advantage of the discharge gap is described in detail later.

Now, a description is given of reduction of poor discharge on the surface of the photosensitive drum 11 caused by the remaining residual toner 81, the additive 82, and the foreign substance 83.

The surface of the photosensitive drum 11 is charged by the discharge generated from the conductive portion 91B of the charging film 91 as similar the first embodiment. In the second embodiment, however, the salient portion 91H is provided in the circumference vicinity of the through hole 91C, so that the surface of the photosensitive drum 11 is stably charged in a middle portion of the charging film 91 by a void formed between the surface of the photosensitive drum 11 and the salient portion 91H in a state that both end portions of the charging film 91 are in contact with the photosensitive drum 11. Moreover, the remaining residual toner 81, the additive 82, and the foreign substance 83 adhered to the surface of the photosensitive drum 11 are removed efficiently. An advantage of having the salient portion 91H is described below.

Since the salient portion 91H provided on the conductive portion 91B of the charging film 91 has a thickness H5 of 5 μm, a space of 5 μm is forcefully formed between the conductive portion 91B and the surface of the photosensitive drum 11. Particularly, the 5 μm space suitable for the discharge is formed in the discharge gaps 103, 104, 105, and 106 in the vicinity of the through holes 91C, so that the discharge is easily generated from the conductive portion 91B with respect to the surface of the photosensitive drum 11, thereby stably charging the surface of the photosensitive drum 11. Since the discharge gaps 104 and 106 in the circumference vicinity of the through holes 91H are positioned backward with respect to the rotation direction of the photosensitive drum 11, the remaining residual toner 81, the additive 82, and the foreign substance 83 are not accumulated. Moreover, the discharge gaps 103 and 105 in the circumference vicinity of the through holes 91H are positioned forward with respect to the rotation direction of the photosensitive drum 11. Therefore, the remaining residual toner 81, the additive 82, and the foreign substance 83 are effectively scraped by the salient portions 91H in a salient tab shape being against with respect to the rotation direction of the photosensitive drum 11, and are cleaned by absorption thereof into the sponge 71.

An advantage of the discharge gaps 101 and 107 respectively in the end portions 91F and 91G of the charging film 91 according to the second embodiment is substantially similar to that of the discharge gaps 73 and 78 respectively in the end portions 12F and 12G of the charging film 12 according to the first embodiment.

According to the second embodiment, each of the through holes 91 provided in the charging film 91 is formed in a rectangular shape with the length L5 of 5 mm (L5=5 mm) and the width W7 of 1 mm (W7=1 mm). However, the shape of the through hole 91 is not limited thereto. The integration degree of the through hole 91H is preferably increased by arrangement of the through hole 91H in zigzag. According to the second embodiment, each of the salient portions 91H provided on the charging film 91 has the length L5 of 5 mm (L5=5 mm), the width W8 of 1 mm (W8=1 mm), and the thickness H5 of 5 μm (H5=5 μm). However, the shape of the salient portions 91H is not limited thereto. A height of the salient portion 91H is preferably smaller than or equal to 50 μm. The salient portion 91H is preferably disposed in such a manner as to be near the through hole 91C.

According to the second embodiment described above, the salient portion 91H is provided on the charging film 91. Therefore, a suitable discharge gap is forcefully formed between the photosensitive drum 11 and the conductive portion 91B, so that the surface of the photosensitive drum 11 is stably charged. Moreover, the salient portion 91H is in the salient tab shape in such a manner as to be against with respect to the photosensitive drum 11, and contacts the photosensitive drum 11, so that the remaining residual toner 81, the additive 82, and the foreign substance 83 are efficiently removed, thereby reducing generation of density unevenness or a vertical line caused by poor charge on the toner image developed on a recording medium 31.

According to the first and second embodiments described above, the image forming apparatus 1 is described as a printing device. However, the first and second embodiments of the present invention may be applied to an image forming apparatus such as a photocopier, a facsimile machine, a multi functional peripheral (MFP).

The present invention has been described above with regard to particular embodiments, but the present invention is not limited thereto. As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. A charging device comprising:

a charging member, in a sheet shape, being secured by contacting a region of an electrostatic latent image to be formed on a rotatable image carrier; and a charging power source portion applying charging voltage to the charging member, wherein the charging member includes a plurality of holes, and wherein the charging member comprises:

a conductive portion allowing the image carrier to be charged; and a base portion holding the conductive portion, wherein each of the plurality of holes serves as a through hole penetrating the conductive portion and the base portion.

2. The charging device according to claim 1, wherein the charging member is urged by an urging member and contacts the image carrier.

3. The charging device according to claim 2, wherein the urging member is made of a foam material.

4. The charging device according to claim 1, wherein each of the plurality of holes has a diameter of smaller than or equal to 5 mm.

5. The charging device according to claim 1, wherein the each of the plural holes is arranged in zigzag in the charging member.

6. A development device comprising a charging device according to claim 2.

7. A charging device comprising:

a charging member, in a sheet shape, being secured by contacting a region of an electrostatic latent image to be formed on a rotatable image carrier; and a charging power source portion applying charging voltage to the charging member, wherein the charging member includes a plurality of holes, and wherein the charging member including a salient portion.

8. The charging device according to claim 7, wherein the salient portion is arranged in such a manner as to be against a rotation direction of the image carrier.

9. The charging device according to claim 7, wherein the salient portion is provided near each of the plurality of holes.

10. The charging device according to claim 7, wherein the salient portion is provided near each of the plurality of holes and contacts the image carrier.

11. The charging device according to claim 7, wherein a plurality of salient portions are provided on the charging member.

12. An image forming apparatus comprising a development device having a charging device according to claim 7.

* * * * *